US006606940B2

(12) United States Patent
Schneid et al.

(10) Patent No.: US 6,606,940 B2
(45) Date of Patent: Aug. 19, 2003

(54) CALENDER

(75) Inventors: Josef Schneid, Vogt (DE); Joachim Hinz, Kempen (DE); Peter Wiemer, Meerbusch (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/796,453

(22) Filed: Mar. 2, 2001

(65) Prior Publication Data

US 2001/0018869 A1 Sep. 6, 2001

(30) Foreign Application Priority Data

Mar. 4, 2000 (DE) ..... 100 10 772

(51) Int. Cl.[7] ..... B30B 15/16; B30B 3/04

(52) U.S. Cl. ..... 100/35; 100/47; 100/163 A; 91/448

(58) Field of Search ..... 100/163 R, 163 A, 100/47; 162/198, 358.3; 91/45, 448; 72/243.2

(56) References Cited

U.S. PATENT DOCUMENTS

| | | | | |
|---|---|---|---|---|
| 3,584,570 A | * | 6/1971 | Sass | 100/163 R |
| 4,736,678 A | | 4/1988 | Stotz | |
| 4,924,772 A | | 5/1990 | Schlunke et al. | |
| 5,038,678 A | * | 8/1991 | Honkala et al. | 100/163 R |
| 5,443,000 A | * | 8/1995 | Wenzel | 100/163 A |
| 5,806,415 A | * | 9/1998 | Lipponen et al. | 100/163 A |

FOREIGN PATENT DOCUMENTS

DE 3702245 8/1988

* cited by examiner

*Primary Examiner*—W. Donald Bray
(74) *Attorney, Agent, or Firm*—Greenblum & Bernstein, P.L.C.

(57) ABSTRACT

Calender that includes a stand, an upper roll, a lower roll, and at least two center rolls arranged between the upper and the lower rolls. The calender also includes at least two cylinders, where the at least two center rolls are supported on the stand by the at least two cylinders. Each of the at least two cylinders include a discharge path that is controlled over more than ¾ of a piston stroke for lowering the at least two center rolls.

26 Claims, 4 Drawing Sheets

CALENDER

CROSS-REFERENCE TO RELATED APPLICATIONS

The present application claims priority under 35 U.S.C. §119 of German Patent Application No. 100 10 772.9, filed on Mar. 4, 2000, the disclosure of which is expressly incorporated by reference herein in its entirety.

BACKGROUND OF THE INVENTION

1. Field of the Invention

The present invention relates to a calender with a stand, an upper roll, a lower roll, and two center rolls located between the upper and lower rolls. The two center rolls are supported on the stand by way of cylinders.

2. Discussion of Background Information

A calender similar in general to that discussed above is known from DE 37 02 245 A1. Further, U.S. Pat. Nos. 4,736,678 and 5,806,415 disclose similar type calenders as well.

Cylinders, which can also be referred to as, e.g., compensation cylinders, are either directly or indirectly supported on the stand or frame of the calender. Further, the cylinders are utilized for different purposes, e.g., during operation, when a material web is glazed, the cylinders compensate for overhanging loads on the roll, e.g., guide rolls or scrapers, or a part of the roll load itself. In a calender according to, e.g., U.S. Pat. No. 5,806,415, even the entire roll weight is compensated by these cylinders. The advantages resulting from this operational mode are more even line loads across the width and higher line loads being possible in the upper nips while maintaining even line loads in the lower nip.

A second purpose of the cylinder is to allow a quick separation of the rolls, i.e., opening the nips as abruptly as possible. Such an opening is necessary in certain situations of malfunctions, e.g., a web break, to avoid damage to the rolls.

Such quick separations are known per se. For this purpose, the lower roll is dropped and the cylinders of the center rolls are relaxed. In order to avoid a hard impact of the rolls, dampening is provided for the final position, i.e., at the end of the piston motion of the cylinders, the cross section for the hydraulic fluid to discharge is reduced so that the roll is slowed more gently to some extent at the end of its motion.

SUMMARY OF THE INVENTION

The present invention is directed to improving the quick separation capabilities of the calender.

According to the invention, a calender of the type mentioned at the outset is provided with a discharge path controlled over more than ¾ of a piston stroke necessary for lowering the center roll.

Further, it is noted that the instant invention is described, by way of example, as a calender in which the center rolls are positioned on the stand by way of levers. However, it is noted that this is purely for the purpose of explanation and illustration, and that other arrangements are likewise contemplated, e.g., positioning the rolls in linear guides.

In accordance with the features of the instant invention, the abilities of control are no longer limited to braking the roll at the end of its motion, which ultimately has the effect of avoiding an abrupt contact of the roll and the shock connected therewith. Moreover, it is possible to control the roll throughout the longest part of its motion. Thus, it is now possible to increase the speed of lowering the rolls and opening the nips. Relatively high motion speeds can be permitted, especially at the beginning of the motion. Additionally, it is now possible to adjust the motion of neighboring rolls to one another so that, during the opening motion, a collision of neighboring rolls can virtually be excluded.

Preferably, the discharge path is controlled by a motion of the piston in relation to the cylinder housing. This results in the control by the motion of the roll itself. External measures are not necessary, so additional control mechanisms can be omitted.

Preferably, the resistance of the discharge path increases the farther the piston is inserted into the cylinder housing. This applies for the usual procedure in which the nips are closed when the piston is extended. In cases in which the nips are closed by a cylinder operating in reverse, the resistance of the discharge path increases accordingly. With such a design, the motion speed of the center roll can be controlled so that the opening motion can be introduced very quickly, but can then be decelerated increasingly. Thus, the entire opening motion requires the same amount of time as in known cases. However, the increase of the nip opening at the beginning of the motion occurs more quickly.

Preferably, the cylinders of different center rolls are provided with different resistances of discharge paths in the case of closed nips, with the resistance increasing from the bottom to the top. This takes into account the fact that the uppermost center roll must travel a shorter total distance than the lowermost center roll. Essentially, the uppermost center roll has to travel only the distance that corresponds to the desired nip opening. The subsequent center roll must already travel a distance twice as long, i.e., the distance necessary for opening the nip between the uppermost and the subsequent center roll by the predetermined amount plus the opening width of the uppermost roll. In order to avoid a collision of the "falling" rolls the resistance of the discharge path is selected such that the uppermost roll falls more slowly and the initial speeds of the rolls during opening increases from the top to the bottom. This can be performed easily by already providing different resistances in the discharge paths before the beginning of the motion of the rolls. The roll with the lowest resistance in the discharge path can remove the hydraulic fluid from the piston the fastest and, therefore, travel a longer distance during the same time.

Preferably, the pistons are embodied identically to one another, but the pistons are extended to different lengths when the nips are closed. When the distance in the discharge paths is dependent on the position of the piston, the relatively simple possibility results of providing different flow resistances for different roll positions in spite of identical pistons. When the piston is inserted farther, the discharge path already has a greater resistance. Such a piston inserted farther can be found in a roll positioned further up. The lowermost center roll has the piston that is pulled out the farthest and, thus, the lowest discharge resistance in the discharge path.

Advantageously, a pipe is provided in the cylinder housing, having openings in its wall and protruding into a bore of the piston. This pipe forms the variable resistances in the discharge path of the cylinder. The more free openings in the wall of the pipe, the smaller the resistance in the discharge path. When the piston is being driven in, more and more openings in the wall of the pipe are covered and, thus, the resistance in the discharge path is automatically increased.

Preferably, the pipe extends into the piston over the entire piston stroke. This allows a speed control over the entire piston stroke. The pipe is guided over the entire piston stroke in the piston and, thus, fixed so that possibility of error remains small.

Preferably, a seal is provided between the piston and the pipe. This creates clearly defined flow relations. Moreover, hydraulic fluid is prevented from seeping through a gap between the piston and the pipe and, thus, from resulting in uncontrolled flow relations.

Preferably, the pipe is open at its face. This is of lesser importance for the lowering motion, i.e., the opening of the nips. However, this opening can be advantageous during closing, i.e., the hydraulic fluid in the interior of the piston can act in a supporting manner so that the piston can be driven out faster.

Advantageously, the pipe is centrally positioned in the cylinder housing and centrally in relation to the piston. In this way, unsymmetrical stress can be omitted.

In one embodiment it may be preferred for the openings to be evenly distributed over the length of the pipe. This can be achieved, e.g., by sizing all openings equally and by positioning them in the longitudinal direction in equal intervals. It is certainly possible as well to distribute several openings in the same "altitude" around the circumference of the pipe. When the piston is inserted into the cylinder housing, it covers a linearly growing opening area and thus reduces the discharge cross section. Naturally, due to the discrete distribution of the openings, this occurs discontinuously, which is of lesser importance. Such a linear behavior can be created by distributing differently sized openings in varying intervals over the length of the pipe. A linear deceleration per se can be achieved using such linear behavior.

In an alternative embodiment, provisions is made for the openings to be distributed over the length of the pipe according to a predetermined non-linear function, with the discharge cross section shrinking disproportionally at the end of the lifting motion. Therefore, the discharge cross section is still the smallest at the end of the lifting motion. However, the increase of the cross section during the exiting of the piston or the reduction of the cross section during the insertion of the piston does not occur linearly, but rather according to another function, preferably a quadratic function. Thus, it is possible to provide a far larger discharge cross section at the beginning of the piston motion, which allows a faster piston movement, while the piston is decelerated more towards the end of the motion.

Preferably, the discharge path is connected to a control device which prevents the pressure in the piston from dropping. When all nips are closed, the center rolls are at least partially supported by the rolls positioned underneath. The cylinders accept some of the load, which is expressed in a corresponding pressure in the cylinders. When the support of the lower rolls is gone, the pressure in the cylinder rises accordingly. The control device ensures that the hydraulic fluid cannot exit the cylinder. However, it also ensures that the pressure in the cylinder does not drop, i.e., that the roll remains held by a certain force. The lowering motion can be controlled well in this manner so that a collision of rolls can be avoided.

In a preferred embodiment, it is even provided for the control device to slightly increase the pressure in the cylinder during the insertion of the piston. This improves the "deceleration behavior" at the end of the motion. Only when the roll has reached its "final position" at which the appropriate nips are completely open the pressure is released. In this case, the roll or the lever can rest on a final contact, for instance.

The present invention is directed to a calender that includes a stand, an upper roll, a lower roll, and at least two center rolls arranged between the upper and the lower rolls. The calender also includes at least two cylinders, where the at least two center rolls are supported on the stand by the at least two cylinders. Each of the at least two cylinders include a discharge path that is controlled over more than ¾ of a piston stroke for lowering the at least two center rolls.

In accordance with a feature of the present invention, each the at least two cylinders can include a piston and a cylinder housing. The discharge path may be controlled by movement of the piston in relation to the cylinder housing.

According to another feature of the invention, a resistance of the discharge path can increase as the piston slides farther into the cylinder housing.

Moreover, each of the at least two cylinders can be assigned to different ones of the at least two center rolls, and the upper roll, the at least two center rolls, and the lower roll may be arranged to form a roll stack. Each cylinder can be structured and arranged to have different resistances in the discharge paths, and the at least two cylinders may be arranged so that the resistance in the discharge path increases from a bottom of the roll stack to a top of the roll stack. The pistons of each of the at least two cylinders may be structurally the same. When the upper roll, the at least two center rolls, and the lower roll are arranged to close the nips between adjacent rolls, each piston can extend from an associated cylinder to a different degree. When the nips are closed, each piston may extend a different distance from the associated cylinder. Further, the distance that each piston extends from the associated cylinder can increase from a bottom of the roll stack to a top of the roll stack.

Each of the at least two cylinders may include a cylinder housing and a piston with a bore, and the calender can further include a pipe located inside the cylinder housing comprising a wall and openings formed through the wall. The pipe may be arranged to extend into the bore. The pipe can slidably extend into the piston over the piston stroke. Further, a seal may be positioned between the piston and the pipe. The pipe can be open on its face. Still further, the pipe may be centrally located in the cylinder housing and centrally in relation to the piston. Moreover, the openings can be evenly distributed over a length of the pipe. Alternatively, the openings can be distributed over a length of the pipe in accordance with a predetermined non-linear function, such that a discharge cross-section shrinks disproportionally at an end of a lifting motion. The predetermined non-linear function may include a quadratic function.

In accordance with still another feature of the invention, each of the at least two cylinders can include a cylinder housing, and the calender may further include a control device coupled to the discharge path to prevent a decrease of pressure in the cylinder housing. Each of the at least two cylinders may further include a piston, and the control device can be structured and arranged to slightly increase pressure in the cylinder during insertion of the piston.

The present invention is directed to a process of quick releasing nips in a calender that includes a stand, an upper roll, a lower roll, at least two center rolls arranged between the upper and the lower rolls, at least two cylinders arranged to support the at least two center rolls on the stand, where each of the cylinders include a discharge path. The process includes lowering the lower roll away, whereby closed nips between adjacent rolls are opened, and, during opening of the nips, controlling a discharge path of the cylinders supporting the at least two center rolls over more than ¾ of a piston stroke for lowering the at least two center rolls.

According to a feature of the instant invention, each of the at least two cylinders can include a piston and a cylinder housing, and the discharge path can be controlled by movement of the piston in the cylinder housing.

In accordance with another feature of the invention, each of the at least two cylinders can include a piston and a cylinder housing, and a resistance of the discharge path may increase as the piston slides into the cylinder housing.

Further, each cylinder can be structurally identical, and a distance traveled by each piston during the opening of the nips may be different.

The present invention is directed to a calender that includes a roll stack including a plurality of rolls, and the plurality of rolls includes an upper roll, a lower roll, and at least two center rolls located between the upper roll and the lower roll. Compensation cylinders are provided, each compensation cylinder including a piston and a cylinder housing. At least one compensation cylinder can be associated with each at least two center rolls. Each compensation cylinder can further include a pipe slidably extendable into the piston, the pipe having a wall and a plurality of through holes arranged over a length of the pipe.

In accordance with a feature of the invention, the pipe can be coupled to the cylinder housing.

In accordance with yet another feature of the instant invention, a pressure chamber may be formed between the piston and the cylinder housing which is filled with hydraulic fluid. The hydraulic fluid may exit the pressure chamber through the through holes and the pipe. Further, as the piston slides into the cylinder housing, a resistance of a flow of the hydraulic fluid in a pressure chamber may be increased due to a reduced number of through holes in the pipe.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

It is noted here that, while the features of the instant invention are described herein in an exemplary embodiment, e.g., as a calender in which the center rolls are positioned on the stand by way of levers, this exemplary embodiment is purely for the purpose of explanation and illustration, and that other arrangements are likewise contemplated, e.g., positioning the rolls in linear guides.

Figure 1:
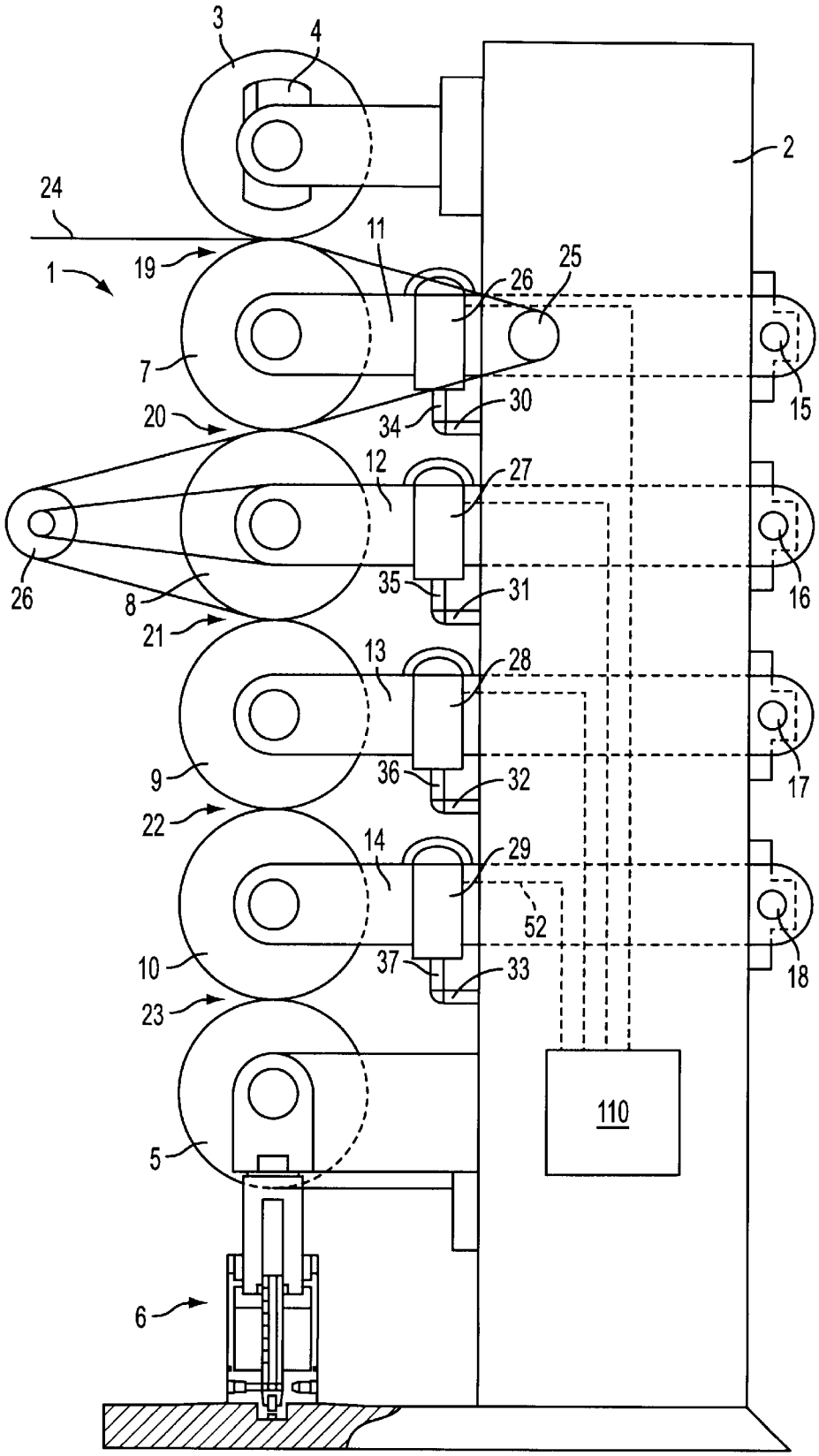
FIG. 1 schematically illustrates a calender in accordance with the features of the instant invention.

FIG. 1 shows a calender 1 with a stand (frame) 2 on which an upper roll 3 with a jacket lift 4 and a lower roll 5 are provided on a contact cylinder 6. Between upper roll 3 and lower roll 5 are several center rolls 7, 8, 9, and 10 which are positioned on levers 11, 12, 13, and 14. Levers 11, 12, 13, and 14 are pivotable around bearing points 15, 16, 17, and 18 on stand 2.

In order to be positioned in the operational position shown, contact cylinder 6 has lifted lower roll 5 which then successively lifted rolls 10, 9, 8, and 7 above to close nips 19, 20, 21, 22, and 23 to glaze a material web, e.g., a paper web. Material web 24 is guided over aiding and guiding devices, e.g., deflection rolls 25, which are depicted only for levers 11 and 12 for reasons of clarity. Furthermore, scraper blades or other additional devices can be provided on levers 11–14.

In order to compensate the weights for these so-called overhanging loads, each lever 11–14 is supported on stand 2 by way a compensating cylinder 26, 27, 28, or 29. In the following description, compensation cylinders 26–29 are referred to a "cylinders" for short. Cylinders 26–29 are all constructed identically. Moreover, the only difference in the arrangement of cylinders 26–29 is the manner in which they are fastened on stand 2, i.e., a distance from a fastening point 30, 31, 32, and 33 from lever 11, 12, 13, and 14, respectively, in the operational position shown. Accordingly, piston rods 34, 35, 36, and 37 of cylinders 26–29 are extended to a different degree from each other.

The reason for this arrangement is that, in case of a malfunction or for introducing a new material web 24, it is necessary to separate the rolls 3, 5, 7, 8, 9, and 10 in order to open nips 19–23. Here, uppermost center roll 7 must be lowered to such an extent that nip 19 reaches a predetermined height, e.g., about 100 mm. The subsequent lower center roll, i.e., center roll 8, must then already be lowered twice as far in order to achieve this opening height for nip 20 as well. The same applies for the remaining nips 21, 22, and 23. The opening motion must occur as quickly as possible, but it is sufficient for the first millimeter of the nip height to be reached relatively quickly. Further, a collision of rolls 5, 7, 8, 9, and 10 during the opening motion must be avoided. Finally, the roll motion should be prevented from ending abruptly. Such an abrupt contact of levers 11–14 onto a final contact of any kind could cause rolls 7–10 to oscillate and they could be destroyed by neighboring structural components, e.g., scraper blades or finger protection moldings.

Figure 2:
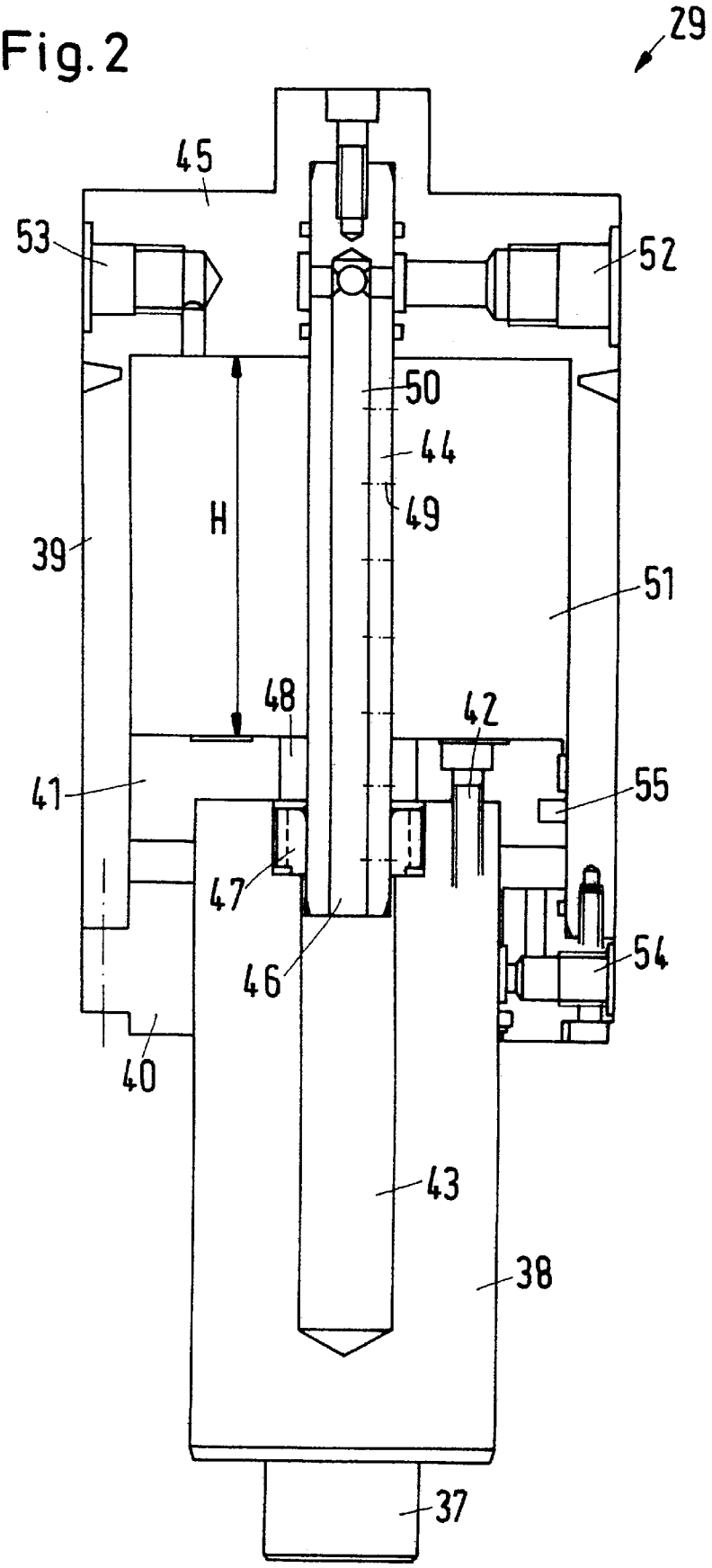
FIG. 2 illustrates a cylinder of the instant invention with an extended piston.
Figure 3:
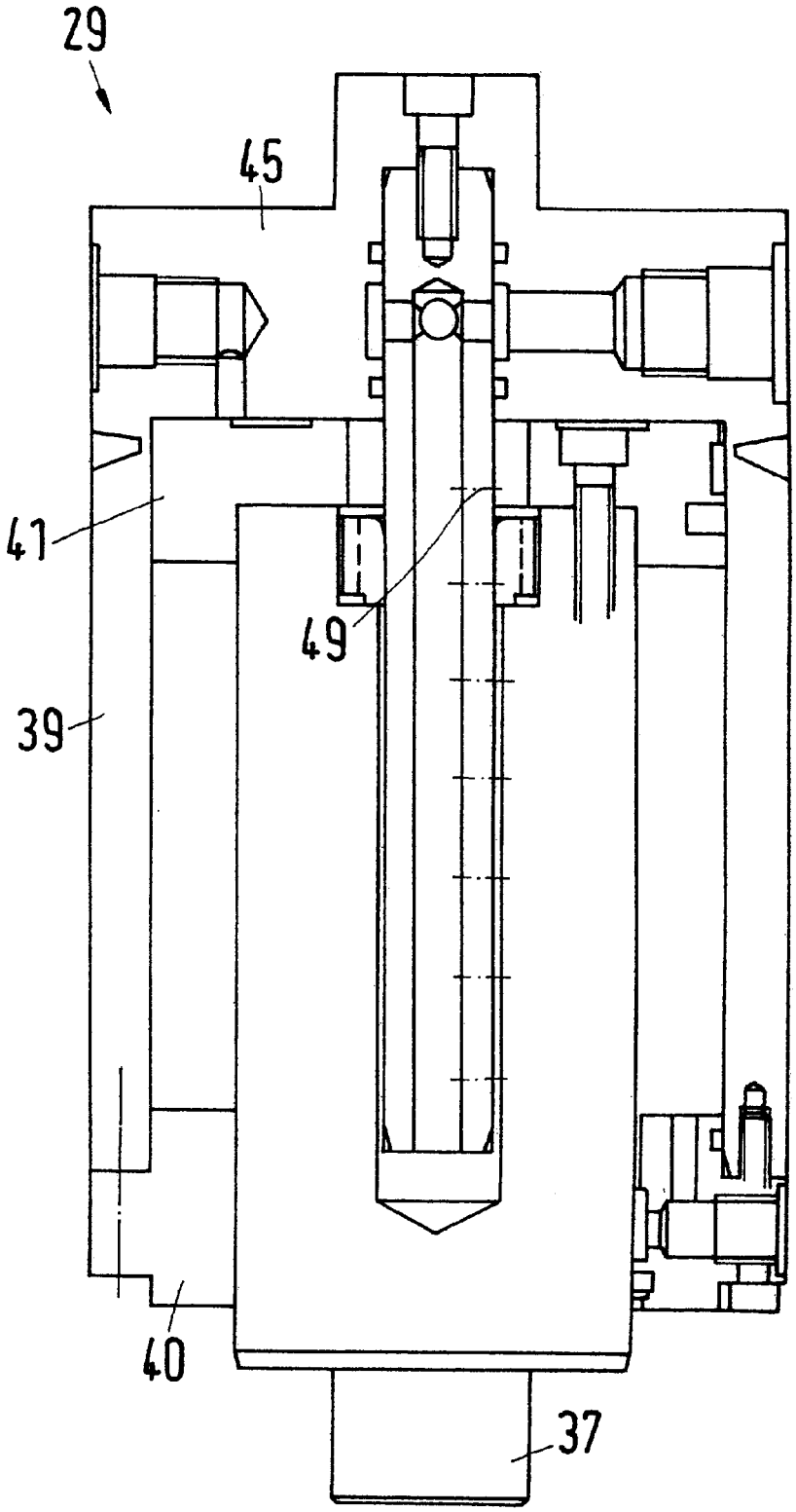
FIG. 3 illustrates the cylinder of the instant invention with an inserted piston.

In order to perform such a controlled motion cylinders 26–29 have a specific design which is to be described using FIGS. 2 and 3, which depict cylinder 29, and which also apply to cylinders 26–28 as well, since they are constructed identically. In this regard, FIG. 2 shows cylinder 29 with an extended piston rod 37 while FIG. 3 depicts cylinder 29 with an inserted piston rod 37.

Piston rod 37 is provided on a piston 38, which is movable in a cylinder housing 39. Piston 38 reaches through a cover plate 40 of cylinder housing 39 and is guided opposite of the circumferential wall of cylinder housing 39 with a face disc 41, which is fastened with the aid of a bolt 42 to piston 38. Piston 38 is provided with a centric bore 43 that extends almost over the entire length of piston 38 and, in any case, is at least as long as stroke H of piston 38.

Pipe 44, fastened at cylinder housing 39, more exactly at a bottom plate 45, reaches or extends into bore 43. On its face, pipe 44 is provided with an opening 46 which opens into bore 43. Pipe 44 is surrounded by a seal 47 that is positioned in bore 43 on the face end of piston 38 such that it contacts pipe 44 in a sealing fashion. Face disc 41 surrounds pipe 44 in a predetermined distance so that a circular space 48 is formed between face disc 41 and pipe 44.

Pipe 44 is provided with a multitude of openings 49 in its wall which extend from a channel 50 formed in the interior of pipe 44 to pressure chamber 51 when piston 38 is extended. Channel 50 is connected to a discharge connector 52. Pressure chamber 51 is provided with another connector 53, with which, e.g., the pressure of the hydraulic fluid in pressure chamber 51 can be determined. However, it is also possible to introduce hydraulic fluid for an accelerated closing of nips 19–23. Furthermore, cylinder housing 39 also has an oil leak connector 54 by which hydraulic fluid that seeped past a sealing arrangement 55 of face disc 41 can be removed.

In the position depicted in FIG. 2, piston 38 is extended to its farthest position out of cylinder housing 39. Accordingly, most of openings 49 are open, i.e., channel 50 and, thus, discharge connector 52 are connected to pressure chamber 51 via openings 49. When contact cylinder 6 is released and lower roll 5 drops, center rolls 7–10 are no longer supported by lower roll 5 so that the entire weight of center rolls 7–10 must be compensated by the appropriate cylinders 26–29. Accordingly, the pressure rises in pressure chamber 51. It is now possible for the hydraulic fluid to exit through a discharge connector 52 via a control device 110 depicted schematically in FIG. 1. Here, the control device ensures that the pressure in pressure chamber 51 does not decrease, but, if necessary, even increases to a small extent.

When the hydraulic fluid can flow out of pressure chamber 51, piston 38 will retract into cylinder housing 39 due to weight forces, whereby the hydraulic fluid is removed through openings 49 into channel 50. With the increasing insertion movement, more and more openings 49 are closed to pressure chamber 51 (or by piston 38) so that flow resistance increases for the exiting hydraulic fluid. This increase in the discharge resistance occurs virtually from the beginning of the motion of piston 38. In the final position, as depicted in FIG. 3, when face disc 41 contacts bottom plate 45, only one opening 49 is open for hydraulic fluid to flow out of pressure chamber 51.

Figure 4:
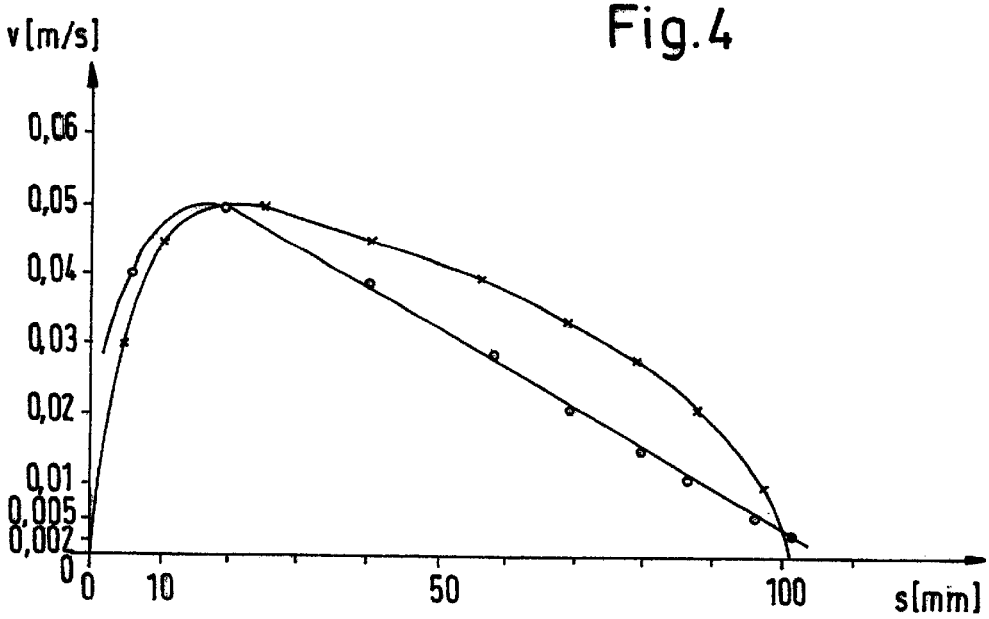
FIG. 4 illustrates two graphs of a dependence of speed on distance in accordance with the instant invention.
Figure 6:
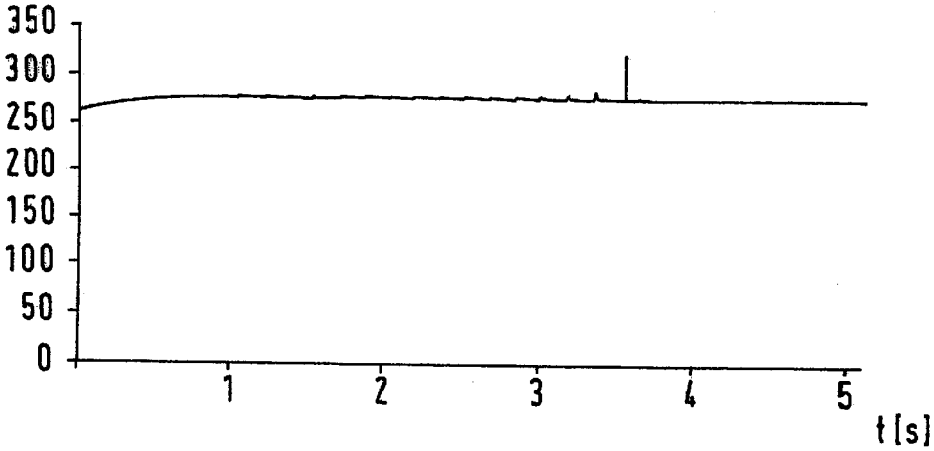
FIG. 6 illustrates a graph of pressure progression over time in accordance with the instant invention.

With this distribution of openings 49 over the axial length of pipe 44, a speed progression can be achieved for the piston motion that is depicted in FIG. 4. FIG. 4 shows here depicts two different alternatives. Circles mark the progression that results when openings 49 are distributed evenly over the length of pipe 44. In this case, piston 38 reaches its maximal speed quickly. The speed then decreases linearly until the final position is reached at about 100 mm. In an alternative embodiment (marked x), openings 49 are distributed according to a quadratic function over the length of pipe 44, i.e., in the position of piston 38 to be extended the farthest a disproportionally large discharge area is open by openings 49 which reduces greatly towards the end of the stroke (FIG. 3). In this case, greater speed is achieved by a longer path of insertion. FIG. 6 shows the movement of piston 38 of cylinder 29 having a stroke of approximately 100 mm. The stroke of the other pistons are shorter by 5 to 25 mm for cylinder 28, 10 to 50 mm for cylinder 27; and 15 to 75 mm for cylinder 26.

Figure 5:
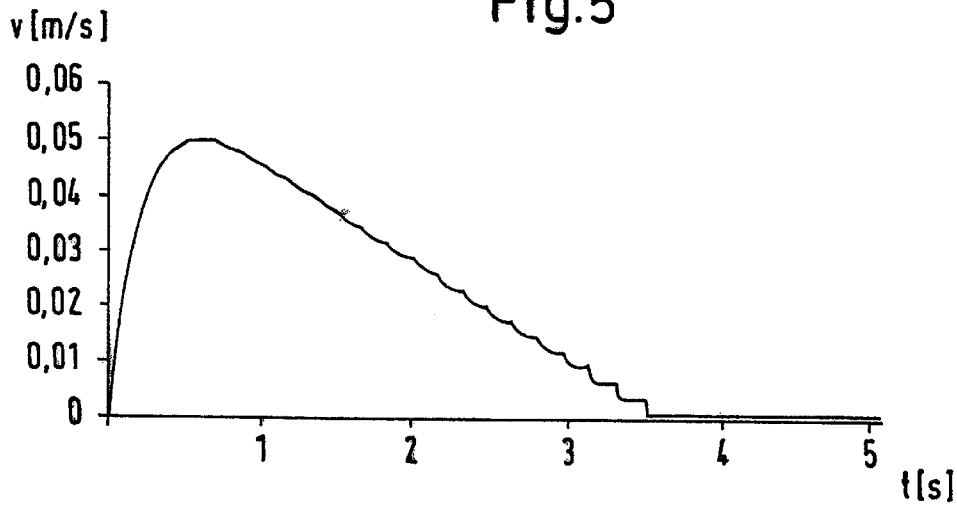
FIG. 5 illustrates a graph of a dependence of speed on time in accordance with the instant invention.

FIG. 5 depicts the distribution of the speed over time. After approximately half a second, the maximum dropping speed of levers 11–14 is reached. Then it reduces in an approximately linear fashion. The small steps depicted in the graph result from the reduction in steps since openings 49 provide no continuously reducing discharge area.

FIG. 6 depicts the pressure situations in pressure chamber 51. Pressure rises slightly. The spikes in the curve are caused by a brief pressure impulse occurring when one of openings 49 slide through seal 47.

As is discernible from FIG. 1, piston rods 34–37 of the separate center rolls 7–10 are extended to a different degree, i.e., piston rod 37 and piston 38 connected to it are further extended in cylinder 29 than in cylinder 26. Accordingly, at the beginning of the opening motion, considerably more openings 49 are available in cylinder 29 for the hydraulic fluid to flow off than in cylinder 26. This results in lever 14 being able to move considerably faster than lever 11. Thus, while center roll 7 moves more slowly than center roll 10, the opening speed is sufficient to achieve the desired nip opening of nip 19.

All center rolls 7–10 move to their respective maximum speed, with this speed being greater at the beginning of the opening motion than at the end. Here, the distribution of the speed is graduated from the bottom towards the top such that each roll positioned below moves faster than the one above. Thus, a collision of neighboring rolls is excluded during the opening of nips 19–23.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A calender comprising:

a stand;

an upper roll;

a lower roll;

at least two center rolls arranged between said upper and said lower rolls;

at least two cylinders, wherein said at least two center rolls are supported on said stand by said at least two cylinders; and each of said at least two cylinders including a discharge path that is controlled over more than ¾ of a piston stroke for lowering said at least two center rolls.

2. The calender in accordance with claim 1, each said at least two cylinders comprising a piston and a cylinder housing, wherein said discharge path is controlled by movement of said piston in relation to said cylinder housing.

3. The calender in accordance with claim 1, wherein a resistance of said discharge path increases as said piston slides farther into said cylinder housing.

4. The calender in accordance with claim 1, wherein each of said at least two cylinders are assigned to different ones of said at least two center rolls, and said upper roll, said at least two center rolls, and said lower roll are arranged to form a roll stack, and wherein each cylinder is structured and arranged to have different resistances in said discharge paths, and said at least two cylinders are arranged so that the resistance in said discharge path increases from a bottom of said roll stack to a top of said roll stack.

5. The calender in accordance with claim 4, wherein said pistons of each of said at least two cylinders are structurally the same, and wherein, when said upper roll, said at least two center rolls, and said lower roll are arranged to close the nips between adjacent rolls, each piston extends from an associated cylinder to a different degree.

6. The calender in accordance with claim 5, wherein, when said nips are closed, each piston extends a different distance from said associated cylinder.

7. The calender in accordance with claim 6, wherein, the distance that each piston extends from said associated cylinder increases from a bottom of the roll stack to a top of the roll stack.

8. The calender in accordance with claim 1, wherein each said at least two cylinders comprises a cylinder housing and a piston with a bore, and said calender further comprises:

a pipe located inside said cylinder housing comprising a wall and openings formed through said wall;

said pipe being arranged to extends into said bore.

9. The calender in accordance with claim 8, wherein said pipe slidably extends into said piston over said piston stroke.

10. The calender in accordance with claim 8, further comprising a seal positioned between said piston and said pipe.

11. The calender in accordance with claim 8, wherein said pipe is open on its face.

12. The calender in accordance with claim 8, wherein said pipe centrally located in said cylinder housing and centrally in relation to said piston.

13. The calender in accordance with claim 8, wherein said openings are evenly distributed over a length of said pipe.

14. The calender in accordance with claim 8, wherein said openings are distributed over a length of said pipe in accordance with a predetermined non-linear function, such that a discharge cross-section shrinks disproportionally at an end of a lifting motion.

15. The calender in accordance with claim 14, wherein said predetermined non-linear function comprises a quadratic function.

16. The calender in accordance with claim 1, wherein each said at least two cylinders comprises a cylinder housing, and said calender further comprises a control device coupled to said discharge path to prevent a decrease of pressure in said cylinder housing.

17. The calender in accordance with claim 16, wherein each said at least two cylinders further comprises a piston, and said control device is structured and arranged to slightly increase pressure in said cylinder during insertion of said piston.

18. A process of quick releasing nips in a calender that includes a stand, an upper roll, a lower roll, at least two center rolls arranged between the upper and said lower rolls, at least two cylinders arranged to support the at least two center rolls on the stand, where each of the cylinders include a discharge path, said process comprising:

lowering the lower roll away, whereby closed nips between adjacent rolls are opened, during opening of the nips, controlling a discharge path of the cylinders supporting the at least two center rolls over more than ¾ of a piston stroke for lowering the at least two center rolls.

19. The process in accordance with claim 18, wherein each of the at least two cylinders includes a piston and a cylinder housing, and wherein the discharge path is controlled by movement of the piston in the cylinder housing.

20. The process in accordance with claim 18, wherein each of the at least two cylinders includes a piston and a cylinder housing, and wherein a resistance of the discharge path increases as the piston slides into the cylinder housing.

21. The process in accordance with claim 18, wherein each cylinder is structurally identical, and a distance traveled by each piston during the opening of the nips is different.

22. A calender comprising:

a roll stack comprising a plurality of rolls, said plurality of rolls including an upper roll, a lower roll, and at least two center rolls located between said upper roll and said lower roll;

compensation cylinders, each compensation cylinder comprising a piston and a cylinder housing, wherein at least one compensation cylinder is associated with each at least two center rolls;

each said compensation cylinder further comprising a pipe slidably extendable into said piston, said pipe comprising a wall and a plurality of through holes arranged over a length of said pipe.

23. The calender in accordance with claim 22, wherein said pipe is coupled to said cylinder housing.

24. The calender in accordance with claim 22, wherein a pressure chamber is formed between said piston and said cylinder housing which is filled with hydraulic fluid.

25. The calender in accordance with claim 24, wherein said hydraulic fluid exits said pressure chamber through said through holes and said pipe.

26. The calender in accordance with claim 25, wherein, as the piston slides into said cylinder housing, a resistance of a flow of said hydraulic fluid in a pressure chamber is increased due to a reduced number of through holes in said pipe.

* * * * *